United States Patent [19]

Rockenfeller et al.

[11] Patent Number: 4,727,694

[45] Date of Patent: Mar. 1, 1988

[54] APPARATUS FOR ANCHORING A TRACTION MEMBER IN THE GROUND

[75] Inventors: Gottfried Rockenfeller, Hilchenbach; Wolfgang Rockenfeller, Hilchenbach-Helberhausen, both of Fed. Rep. of Germany

[73] Assignee: Rockenfeller KG Befestigungselemente, Hilchenbach, Fed. Rep. of Germany

[21] Appl. No.: 909,126

[22] Filed: Sep. 18, 1986

[30] Foreign Application Priority Data

Sep. 19, 1985 [DE] Fed. Rep. of Germany ..... 3533408

[51] Int. Cl.[4] ..... E02D 5/74

[52] U.S. Cl. ..... 52/163

[58] Field of Search ..... 52/153, 155–159, 52/162–164, 166

[56] References Cited

U.S. PATENT DOCUMENTS 768,705 8/1904 Swan ..... 52/163

972,306 10/1910 Wilcox ..... 52/163

FOREIGN PATENT DOCUMENTS 161190 5/1985 European Pat. Off. ..... 52/163

2711979 11/1981 Fed. Rep. of Germany ..... 52/163

*Primary Examiner*—Carl D. Friedman

*Attorney, Agent, or Firm*—Karl F. Ross; Herbert Dubno

[57] ABSTRACT

An apparatus for anchoring a traction member comprising an anchoring element which is a molded piece with a transverse cross section small compared to the longitudinal cross section thereof and an insertable guiding rod couplable detachably with the anchoring element and alignable longitudinally with it. An attaching piece for the traction member is mounted laterally on the anchoring element with spacing from both ends of it. An anchoring body of the anchoring element is provided with a cutter like tapered front end and on a rear end has a sectioning for nonrotatable engagement with the insertable guiding rod. The attaching piece for the traction member is mounted between the center of gravity of the anchoring body and the front end of the anchoring body. At and/or near the attaching piece for the traction member an arm is mounted so as to be limitedly pivotable the rear end of which is associated with the rear end of the anchoring body. By spreading the arm with respect to the anchoring body the process of anchoring in the earth is optimized.

11 Claims, 7 Drawing Figures

APPARATUS FOR ANCHORING A TRACTION MEMBER IN THE GROUND

CROSS REFERENCE TO RELATED APPLICATION

This application is related to the commonly owned copending application Ser. No. 879,808 filed June 27, 1986.

FIELD OF THE INVENTION

Our present invention relates to a ground anchor for a pulling or traction member such as a cable, rope, chain or the like, i.e. to a deadboy for such an elongated element.

BACKGROUND OF THE INVENTION

A known apparatus for anchoring a traction member comprises an anchoring body formed as a molded piece with a transverse cross section which is small compared to its length and a guiding and drawing rod couplable detachably with it and alignable longitudinally with the anchoring body. The attaching piece for the traction member is mounted laterally on the anchoring body with spacing from both its ends (see U.S. Pat. No. 972,306 and German patent No. 27 11 979).

In one known ground or earth anchor, an insertable anchoring body is used which has a rear end bent so that it is inclined with respect to the longitudinal axis of the anchoring body. On the side of the anchoring body opposite the outwardly bent portion of its rear end between its center of gravity and that rear end, an attaching piece is provided for the traction member.

According to U.S. Pat. No. 972,306, the anchoring body is a substantially flat steel plate with arrow-shaped ends and a mounting shoe for the connecting or guiding rod and is attached to one flat side of the steel plate by welding or riveting. Furthermore, the mounting shoe has an eye for attachment of a traction member. According to German patent No. 27 11 979, the anchoring body is made from a pipe section having a recess which is suitable for receiving the connecting or guiding rod and at its inside front end has a constricted section which is a bearing shoulder for the connecting or guiding rod.

The ground anchor of German patent No. 27 11 979 has, in contrast to that of U.S. Pat. No. 972,306, an advantage, namely that it may be manufactured easily in one piece from a pipe section which need be provided with no additional elements of structure, since the attaching piece for the traction member can be a handle or hook-like piece of the pipe section cut out or pressed out from the pipe section.

Both above-mentioned known ground or earth anchors have the disadvantage, however, that for automatic pivoting into their anchoring position with a force acting on the traction member, they must be cut not only at their rear end inclined to their longitudinal axes and must be provided with a lip-shaped bent-out section, but also simultaneously the attaching piece for the traction member must be mounted so that it is on the side opposing the bent out section of the rear end and between the center of gravity and the rear end.

Practical experience has shown that after an erroneous insertion in unbroken ground or filled earth, these known earth or ground anchors cannot be removed but are lost unless dug out of the ground in a difficult and time-consuming way.

The desired withdrawal from the ground after an erroneous insertion through the shaft or hole in the earth formed by the anchor is prevented by the particular shape of its rear end which is inclined to its longitudinal axis and lip shaped bent outwards. An upwardly directed force exerted by the pulling means invariably digs the anchor into the surrounding earth and as a consequence slants it in an undesirable way in the direction of its anchoring position even when it is still engaged with the connecting or guiding rod used to drive it into the ground.

These known earth or ground anchors can not be driven into stoney ground without problems. In case of the earth or ground anchor of U.S. Pat. No. 972,306 the front point of the steel plate of the anchoring body is bent away laterally comparatively easily on encountering a flat thick stone and thus is prevented from further penetration to sufficient depth in the ground. Also the ground and/or earth anchor according to German patent No. 27 11 979 on account of its comparatively large circular front surface can not pass stones in its path and can be prevented from penetrating to a sufficient depth in the ground.

OBJECTS OF THE INVENTION

It is an object of our invention to provide an improved apparatus, such as a deadboy or ground anchor, for anchoring a pulling or traction member in the ground which obviates the aforedescribed drawbacks.

It is a further object of the invention to provide an improved apparatus for anchoring a traction member, such as a rope, line, chain or the like, in unbroken or disturbed ground, and which in the case of an erroneous insertion may be drawn out of the shaft in the ground and reused without problems.

It is another object of the invention to provide an improved apparatus for easily anchoring to a sufficient depth a traction member such as a cable, wire, chain or the like in unbroken or undisturbed earth having stoney layers.

SUMMARY OF THE INVENTION

These objects and others which will become more readily apparent hereinafter, are attained in accordance with our invention in an apparatus for anchoring a traction member comprising an anchoring body which is a molded or shaped piece with a transverse cross section small compared to its longitudinal cross section and an insertable guiding rod couplable detachably with the anchoring body and alignable longitudinally with the anchoring body. The attaching piece for the traction member is mounted laterally on the anchoring body with spacing from both ends of the anchoring body.

According to our invention, the anchoring body is provided with a cutter-like tapered front end and simultaneously on a rear end with a sectioning for nonrotatable engagement with the insertable guiding rod. The attaching piece for the traction member is mounted between the center of gravity of the anchoring body and the front end of the anchoring body at and/or near the attaching piece for the traction member. An arm is mounted at or near said attaching piece so as to be limitedly pivotable, the rear end of this arm being associated with the rear end of the anchoring body. The arm forms together with the anchoring body a spreadable anchoring element.

By using the invention, the insertion of the anchoring body to the desired depth in stoney ground is facilitated and it is also guaranteed that an anchoring body, which is erroneously or incorrectly put in place may be drawn out from the shaft in the ground using the insertable guiding rod and can then be reused.

Since the rear end of the arm can be simultaneously grasped with the rear end of the anchoring body by the insertable guiding rod, it is possible to spread it relative to the anchoring body only after the insertable guide rod is pulled away.

The knife like tapered front end of the anchoring body not only makes insertion into normal ground easy but also contributes to the break up of stone layers found near the shaft in the ground for the anchoring body. The breaking up of such stone layers is then facilitated since the anchoring body is allowed to pivot or rotate about its axis during the anchor insertion process with the help of the insertable guiding rod not only about its longitudinal axis but simultaneously also can be pivoted away from stones acting as hindrances. By spreading the arm from the anchoring body a barb or fan effect occurs which substantially improves the anchoring of the apparatus in the earth.

It is particularly advantageous when the arm is pivotable from a position parallel to the anchoring body into a position inclined at a sharp angle to the anchoring body.

The spreading of the arm from the anchoring body is especially useful when the rear end of the arm has a shovel like deformation which cuts into the ground on application of a force to the traction member and forces the lateral pivotal motion of the arm.

A structurally and operationally good design of the apparatus of the invention is provided in an embodiment in which both the anchoring body and the arm have a T-shaped cross section and are attached to each other pivotally at the attaching piece.

In another embodiment of our invention, both the anchoring body and the arm have a U-shaped cross section and their U-arms are pivotally attached to each other. This embodiment is particularly suited for uses in which there is a big load on the earth anchor.

The anchoring body and the arm can be attached to each other jointly at the attaching piece and can be jointly attached detachably with the traction member.

The spreading action of the arm relative to the anchoring body is particularly favored because the traction member can contact on a bearing surface of the arm at least with a lower end portion of a suitable length. When a force acts on the traction member a forced pivoting of the arm occurs relative to the anchoring body and assists the desired spreading process.

Advantageously the traction member can contact on the bearing surface of the arm at least with a lower end portion of suitable length.

In another embodiment of the invention, one of the parts of the anchoring element, for example, the anchoring body, has a T-shaped cross section while another part of the anchoring element for example, the arm, has a U-shaped section cross section and embraces with the U-legs of the arm the T-shaped leg of the anchoring body.

BRIEF DESCRIPTION OF THE DRAWING

The above and other objects, features and advantages of our invention will become more readily apparent from the following description, reference being made to the accompanying drawing in which.

SPECIFIC DESCRIPTION

In many cases, it is necessary to anchor a traction member 31 for example, a cable, rope, line, chain or the like, in unbroken earth or in loosened earth or fill with the smallest possible expenditure of energy, but securely enough to anchor it properly.

Figure 1:
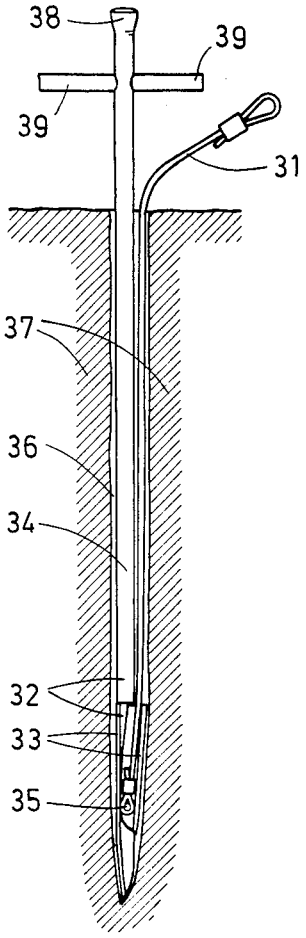
FIG. 1 is a reduced side elevational view of an apparatus for anchoring a traction member in the ground according to our invention at the end of the insertion process.
Figure 2:
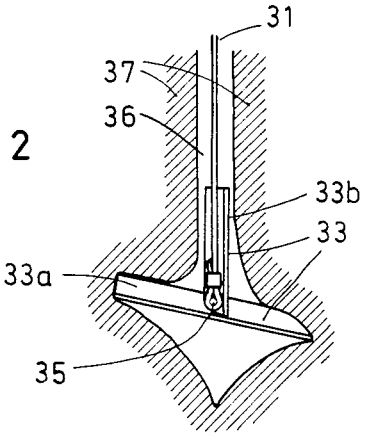
FIG. 2 is a side elevational view of a portion of the apparatus according to FIG. 1 placed at the lower end of a shaft in the ground in an anchored position.

In order to make that possible a special anchoring device 32 is required which comprises an anchoring element 33 with a small transverse cross section compared to its length or longitudinal cross section and an insertable guiding rod 34 couplable detachably with it and alignable longitudinally with this anchoring element 33 as is apparent from FIG. 1.

The anchoring element 33 comprises an anchoring body **33*a* and an arm 33*b* attached to the anchoring body 33*a* at 35 so as to be limitedly pivotable. The free and/or rear end of this arm 33*b* is positioned adjacent the rear end of the anchoring body 33*a* during the insertion process as can be seen from FIGS. 1, 3 and 4**.

The traction member 31 and/or a plastic coated steel line, a chain or the like attaches to the anchoring element 33 and of course to the anchoring body **33*a* near the attaching piece 35 of the arm 33*b***.

As can be seen from FIG. 1, the anchoring element 33 may be inserted from above in the unbroken earth 37 with the help of the insertable guiding rod 34 simultaneously forming the shaft 36. For this purpose, a few forceful hammer blows are applied to the upper end of the insertable guiding rod 34. Two radially directed handles 39 below the enlarged head 38 on opposite sides of the insertable guiding rod 34 are used for holding, guiding and rotating the insertable guiding rod 34 and with it also the anchoring element 33 during the insertion process. The insertable guiding rod 34 cannot only be rotated about its longitudinal axis, but it is also possible to influence the insertion direction of the anchoring element 33 in the ground 37.

Simultaneously on insertion of the anchoring element 33 into the ground 37, the traction member 31 is pulled to a depth corresponding to the insertion depth of the anchoring element 33 in the shaft 36, since it is attached with the anchoring element 33.

Figure 3:
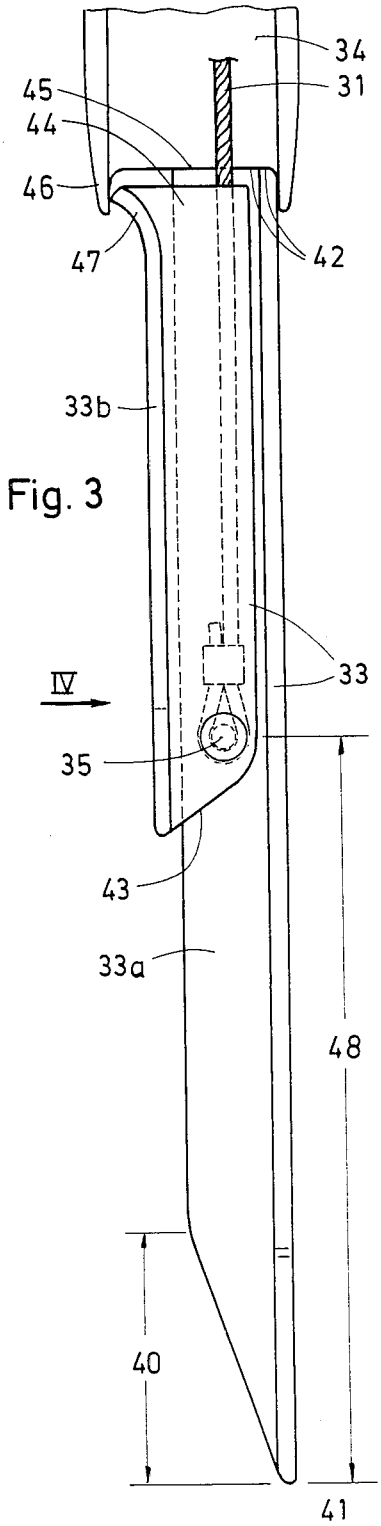
FIG. 3 is a side elevational view showing the chief components of an apparatus according to our invention for anchoring a traction member in the ground with the lower end of an associated insertable guiding rod in its natural size.
Figure 4:
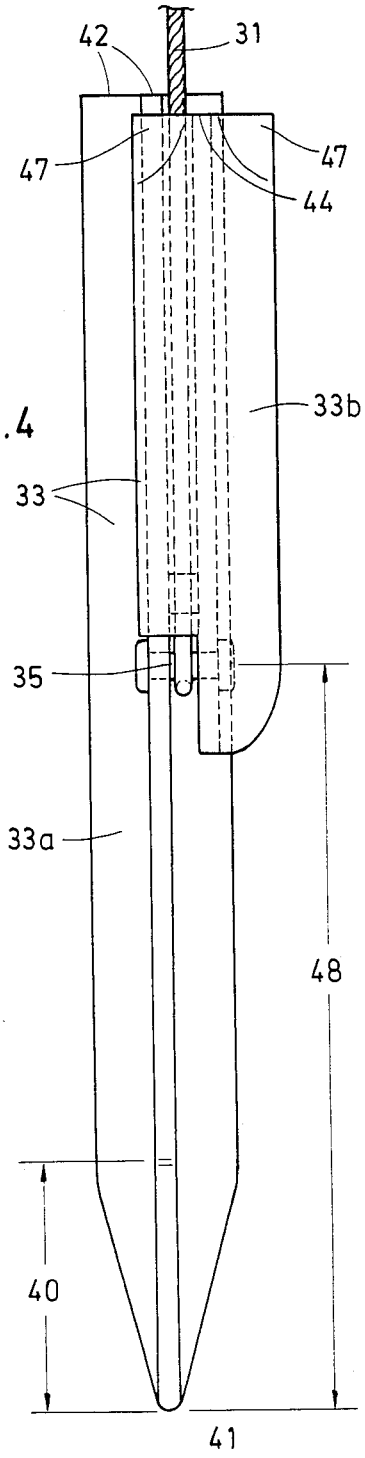
FIG. 4 is a front elevational view of the apparatus of FIG. 3 as seen in the direction of the arrow IV.
Figure 5:
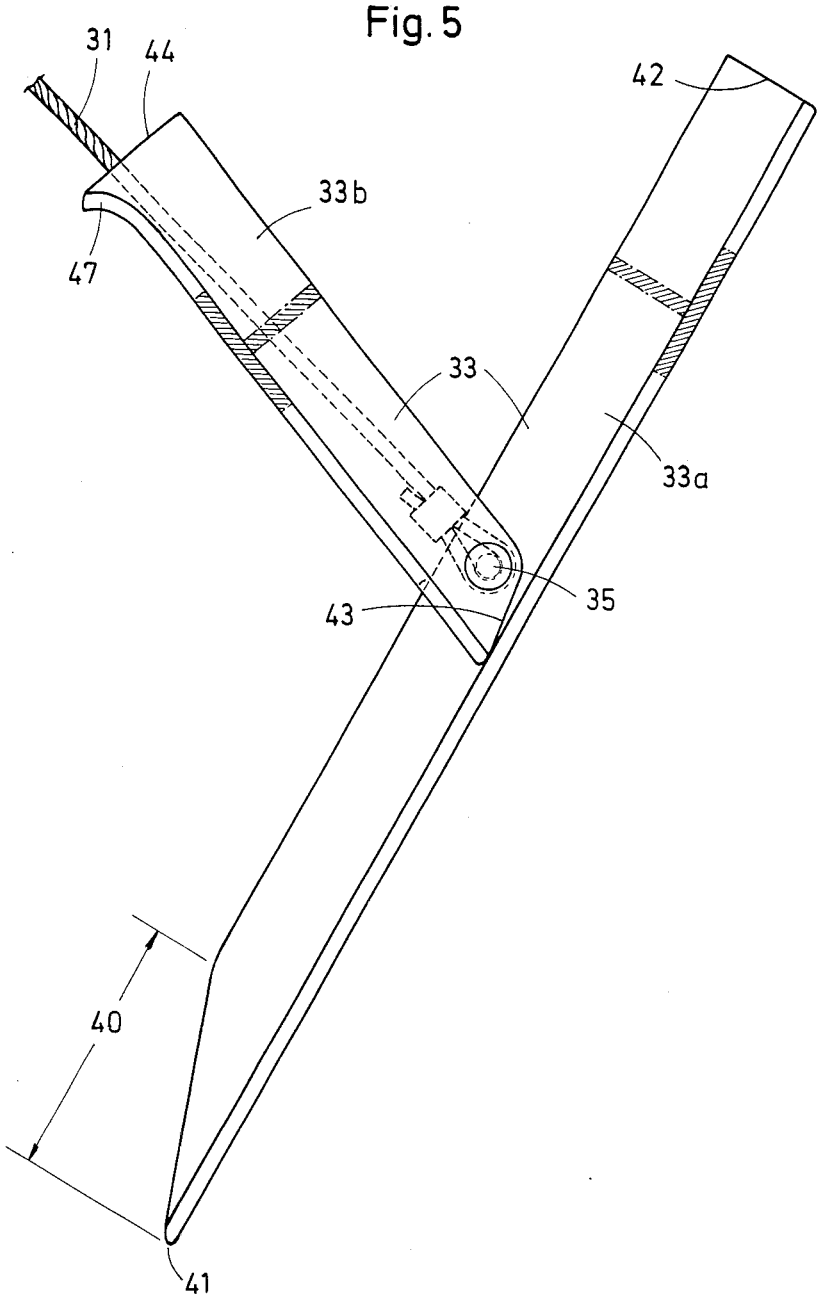
FIG. 5 is a side elevational view of the apparatus of FIGS. 3 and 4 in a spread configuration.

From FIGS. 3 to 5 of the drawing it is apparent that not only the anchoring body **33*a* but also the arm 33*b*** pivotally attached to it at attaching piece 35 can be a molded piece which can have a T-shaped cross section as indicated by the dot-dashed lines and cross hatch lines in FIG. 5.

The front end portion 40 of the anchoring body 33*a* is provided with beveling on all three sections of its T-shape cross section so that it comes to a point 41 at its free end.

The rear end 42 of the anchoring body 33*a* forms with its T-shape cross section a planar supporting and/or contacting surface for the front end of the insertable guiding rod 34 as is indicated clearly in FIG. 3.

The arm 33*b* of the anchoring element 33 has on the end which is adjacent to the attaching piece 35, which in this embodiment is a head bolt, a contacting surface 43 on its T-leg which limits the pivot angle of the arm 33*b* relative to the anchoring body 33*a* as can be seen clearly from FIGS. 3 and 5.

The rear end 44 of the arm 33*b* is associated with the rear end 42 of the anchoring body 33*a* in as much as the arm 33*b* can take a position parallel to the anchoring body 33*a* (FIGS. 1 and 3).

In the position shown in FIG. 3, the free lower end of the insertable guiding rod 34 embraces the rear lower ends 42 and 44 of the anchoring body 33*a* and the arm 33*b* jointly as has been made apparent from FIG. 3. Thus the insertable guiding rod 34 with molded insertion shoulder 45 contacts on the rear end 42 of the anchoring body 33*a* and embraces it and also engages nonrotatably the rear end 44 of the arm 33*b* with a projecting edge 46.

A rotation of the insertable guiding rod 34 about its longitudinal axis results in a corresponding rotation of the anchoring element 33 about its longitudinal axis.

On the rear end 44 of the arm 33*b* both T-arms lying in the same plane are provided with shovel like bent out lip deformation 47 as is apparent from FIGS. 3 to 5.

The attaching piece 35 of the arm 33*b* on the anchoring body 33*a*, which is also at the place of attachment of the traction member 31 on the anchoring element 33, is a distance 48 from the point 41 on the front end portion 40 of the anchoring body 33*a* which is at most half the entire length of the anchoring body 33*b*, but advantageously is less than that. It is thereby guaranteed, that in an anchoring operation the traction member 31 forces the anchoring body 33*a* into an inclined position in the shaft 36 which leads to a lateral shift of the anchoring body 33*a* from the shaft 36 and because of that its ends 41 and 42 pointing away from each other are forced into the surrounding earth 37.

Since the traction member 31 bears on one of the parallel sections of the arm 33*b* during the pivotal motion of the anchoring body 33*a* and exerts a lateral force on it the arm 33*b* is pivoted about the attaching piece 35 relative to the anchoring body 33*a* while its shovel-like bent-out deformation 47 is oriented in the surrounding earth 37 in a direction which is directed away from the direction in which the end 42 of the anchoring body 33 is dug in. Because of that, a forceful spreading of the arm 33*b* relative to the anchoring body 33*a* pushes its contacting support 43 against the inner side or section arm of the anchoring body 33*a* as can be seen from FIG. 5. The spreading action of the arm 33*b* from the anchoring body 33*a* has the consequence that the anchoring element 33 enters into an optimum and very strong anchoring in the ground 37.

In many cases, it is advantageous to have the anchoring body 33*a* and the arm 33*b* of the anchoring element 33 attached with each other by a threaded pivot bolt and detachable from the traction member 1. In this case the arm 33*b* is coupled with the anchoring body 33*a* only to form the anchoring element 33 when a very strong anchoring with the surrounding earth 37 is to be made.

Figure 6:
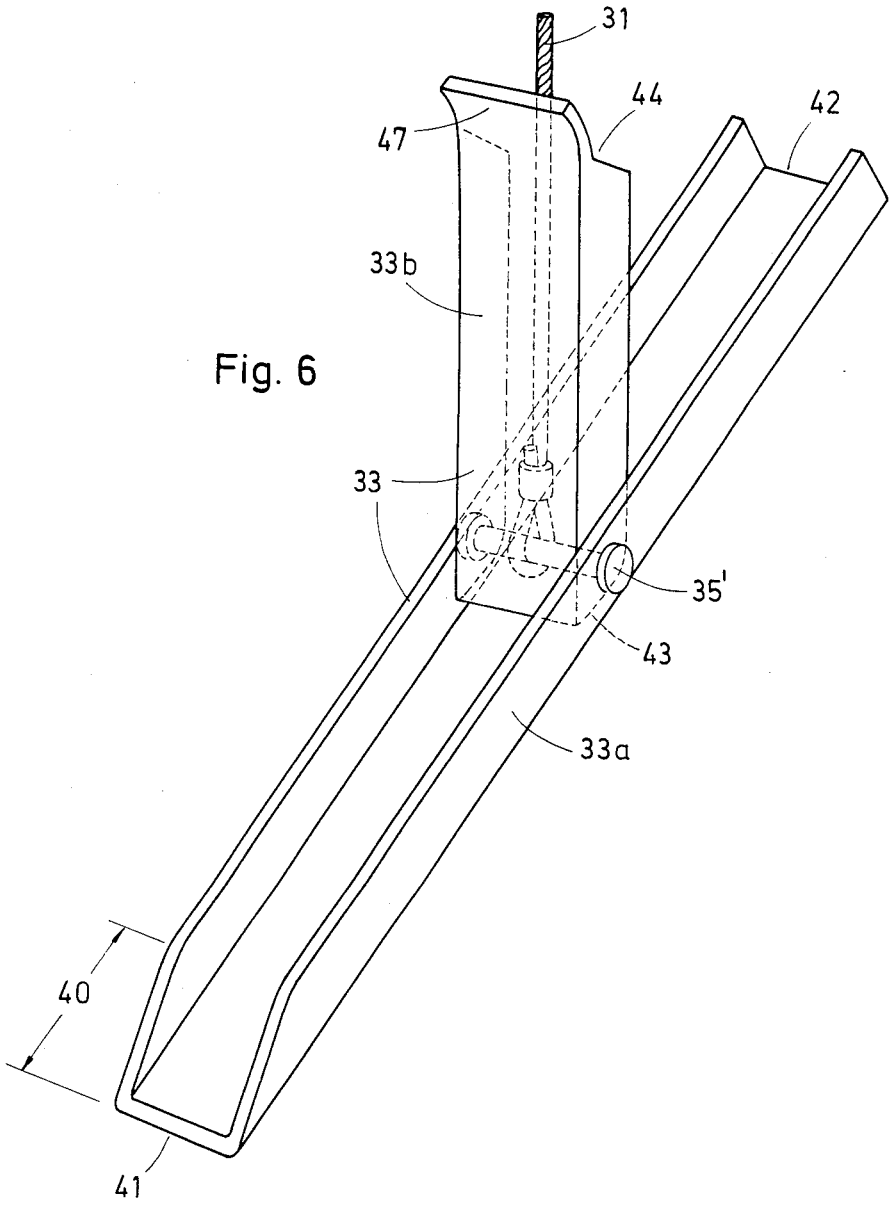
FIG. 6 is a perspective view of another embodiment of the apparatus for anchoring a traction member in the ground showing its chief components.

In FIG. 6, a variant of the anchoring element 33 according to FIGS. 3 to 5 is shown. In this embodiment the anchoring body 33*a* and the arm 33*b* do not have a T-shaped cross section but instead have a U-shaped cross section. The U-shaped pieces are provided with open U-sides facing each other and the pivot bolt 35' passes through both U arms and the anchoring body 33*a* as well as the arm 33*b*. In the space between both U-shape sections the traction member 31, for example a wire cable, is attached to pivot bolt 35' by a cable grommet.

Figure 7:
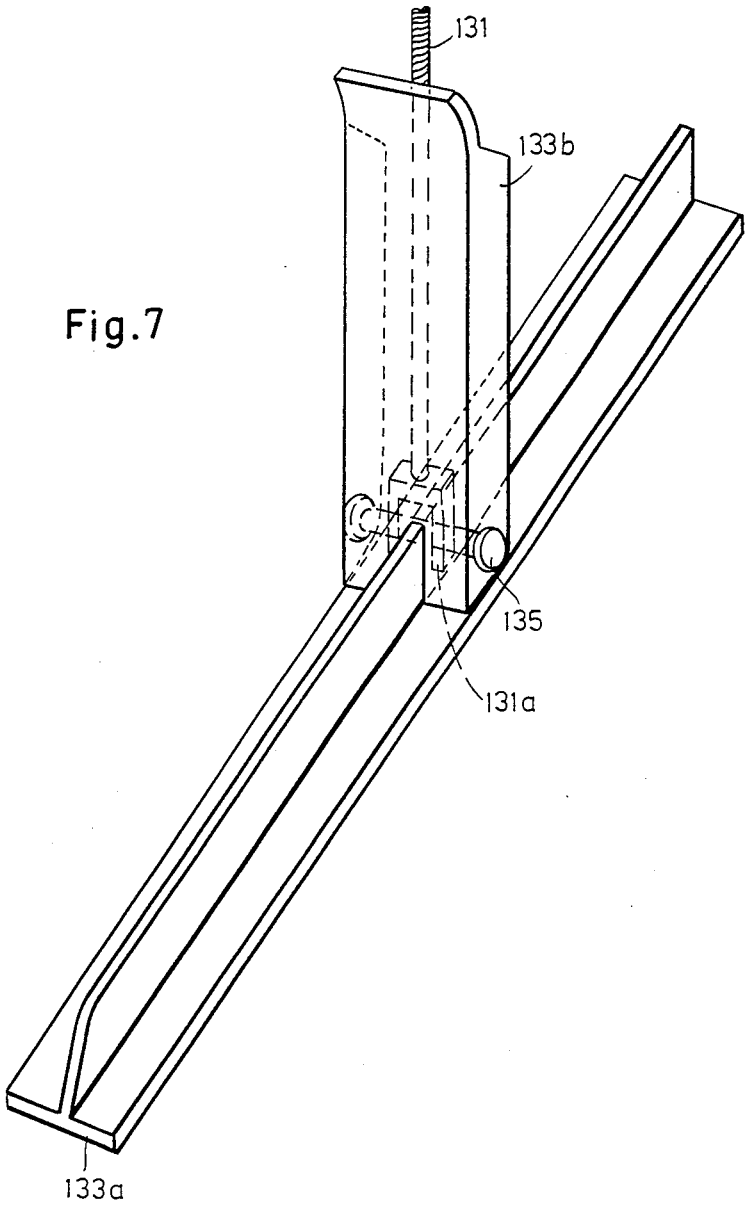
FIG. 7 shows, in a view similar to FIG. 6, another embodiment.

FIG. 7 shows an embodiment otherwise similar to that of FIG. 6 wherein the arm 133*b* is a U-section or channel while the body 133*a* is of T-section, the pin 135 passing through the shanks of the channel and the web of the T-section as shown. The head 131*a* pivotally connecting the cable 131 to the pin 135 straddles the web of the T. This device operates in the same way as that of FIGS. 1 and 6.

We claim:

1. In an apparatus for anchoring a traction member comprising an elongated anchoring body and an insertable guiding rod couplable detachably with said anchoring body and alignable longitudinally with said anchoring body, and attaching piece for said traction member being mounted laterally on said anchoring body with spacing from both ends of said anchoring body, the improvement wherein said anchoring body is provided with a cutter-like tapered front end and simultaneously on a rear end with a section for nonrotatable engagement with said insertable guiding rod and said attaching piece for said traction member is mounted between the center of gravity of said anchoring body and the front end of said anchoring body and at and/or near said attaching piece for said traction member an arm is mounted so as to be limitedly pivotable, the rear end of which is associated with said rear end of said anchoring body and which forms together with said anchoring body a spreadable anchoring element, and wherein said rear end of said arm has a shovel-like configuration.

2. The improvement defined in claim 1 wherein said arm is pivotable from a position parallel to said anchoring body into a position inclined at an acute angle to said anchoring body.

3. The improvement defined in claim 1 wherein both said anchoring body and said arm have a T-shaped cross section and are attached to each other pivotally at said attaching piece.

4. The improvement defined in claim 1 wherein a contacting support is provided to bound a pivoted inclined position of said arm.

5. In an apparatus for anchoring a traction member comprising an elongate anchoring body and an insertable guiding rod couplable detachably with said anchoring body and alignable longitudinally with said anchoring body, and attaching piece for said traction member being mounted laterally on said anchoring body with spacing from both ends of said anchoring body, the improvement wherein said anchoring body is provided with a cutter-like tapered front end and simultaneously on a rear end with a section for nonrotatable engagement with said insertable guiding rod and said attaching piece for said traction member is mounted between the center of gravity of said anchoring body and the front end of said anchoring body and at and/or near said attaching piece for said traction member an arm is mounted so as to be limitedly pivotable, the rear end of which is associated with said rear end of said anchoring body and which forms together with said anchoring body a spreadable anchoring element, and wherein both said anchoring body and said arm having a U-shaped cross section and are attached to each other pivotally both U-legs of said said anchoring body and said arm.

6. In an apparatus for anchoring a traction member comprising an elongated anchoring body and an insertable guiding rod couplable detachably with said anchoring body and alignable longitudinally with said anchoring body, and attaching piece for said traction member being mounted laterally on said anchoring body with spacing from both ends of said anchoring body, the improvement wherein said anchoring body is provided with a cutter-like tapered front end and simultaneously on a rear end with a section for nonrotatable engagement with said insertable guiding rod and said attaching piece for said traction member is mounted between the center of gravity of said anchoring body and the front end of said anchoring body and at and/or near said attaching piece for said traction member an arm is mounted so as to be limitedly pivotable, the rear end of which is associated with said rear end of said anchoring body and which forms together with said anchoring body a spreadable anchoring element, and wherein said anchoring body and said arm being attached to each other at said attaching piece and are attached detachably with said traction member.

7. In an apparatus for anchoring a traction member comprising an elongated anchoring body and an insertable guiding rod couplable detachably with said anchoring body and alignable longitudinally with said anchoring body, and attaching piece for said traction member being mounted laterally on said anchoring body with spacing from both ends of said anchoring body, the improvement wherein said anchoring body is provided with a cutter-like tapered front end and simultaneously on a rear end with a section for nonrotatable engagement with said insertable guiding rod and said attaching piece for said traction member is mounted between the center of gravity of said anchoring body and the front end of said anchoring body and at and/or near said attaching piece for said traction member an arm is mounted so as to be limitedly pivotable, the rear end of which is associated with said rear end of said anchoring body and which forms together with said anchoring body a spreadable anchoring element, and said traction member is contacted on the bearing surface of said art at least with a lower end portion of suitable length.

8. In an apparatus for anchoring a traction member comprising an elongated anchoring body and an insertable guiding rod couplable detachably with said anchoring body and alignable longitudinally with said anchoring body, and attaching piece for said traction member being mounted laterally on said anchoring body with spacing from both ends of said anchoring body, the improvement wherein said anchoring body is provided with a cutter-like tapered front end and simultaneously on a rear end with a section for nonrotatable engagement with said insertable guiding rod and said attaching piece for said traction member is mounted between the center of gravity of said anchoring body and the front end of said anchoring body and at and/or near said attaching piece for said traction member an arm is mounted so as to be limitedly pivotable, the rear end of which is associated with said rear end of said anchoring body and which forms together with said anchoring body a spreadable anchoring element, one of the parts of said anchoring element having a T-shaped cross section, while another part of said anchoring element has a U-shaped cross section and the U-legs of said arm embrace the T-leg of said anchoring body.

9. The improvement defined in claim 8 wherein said one part is said anchoring body and said other part is said arm.

10. An apparatus for anchoring a traction member comprising:

an anchoring body which is a molded piece with a T-shaped transverse cross section which is small compared to the longitudinal cross section thereof with a cutter like tapered front end and with a sectioning on a rear end;

an insertable guiding rod couplable detachably with said anchoring body by nonrotatable engagement with said sectioning and alignable longitudinally with said anchoring body;

an attaching piece for said traction member being mounted laterally on said anchoring body with spacing from both ends of said anchoring body between the center of gravity of said anchoring body and the front end of said anchoring body;

near said attaching piece for said traction member an arm having a T-shaped cross section is mounted so as to be limitedly pivotable from a position parallel to said anchoring body into a position inclined at a sharp angle, the rear end of said arm being associated with said rear end of said anchoring body and which forms together with said anchoring body a spreadable anchoring element;

a shovel like deformation on said rear end of said arm; and a contacting support on the pivot end of said arm to limit the pivoted inclined positions of said arm.

11. In an apparatus for anchoring a traction member comprising an elongated anchoring body and an insertable guiding rod couplable detachably with said anchoring body and alignable longitudinally with said anchoring body, and attaching piece for said traction member being mounted laterally on said anchoring body with spacing from both ends of said anchoring body, the improvement wherein said anchoring body is provided with a cutter-like tapered front end and simultaneously on a rear end with a section for nonrotatable engagement with said insertable guiding rod and said attaching piece for said traction member is mounted between the center of gravity of said anchoring body and the front end of said anchoring body and at and/or near said attaching piece for said traction member an arm is mounted so as to be limitedly pivotable, the rear end of which is associated with said rear end of said anchoring body and which forms together with said anchoring body a spreadable anchoring element and a contacting support on a front end of said arm provided to contact against an inner side of a section arm of said anchoring body.

* * * * *